US005284281A

United States Patent [19]

Nichols

[11] Patent Number: 5,284,281

[45] Date of Patent: Feb. 8, 1994

[54] HOLSTER WITH TRIGGER GUARD GRIPPING DEVICE

[76] Inventor: Richard E. D. Nichols, 13223 Black Mountain Rd., #357, San Diego, Calif. 92129

[21] Appl. No.: 771,206

[22] Filed: Oct. 4, 1991

[51] Int. Cl.[5] ..... F41C 33/02

[52] U.S. Cl. ..... 224/244; 224/193; 224/911

[58] Field of Search ..... 224/911, 912, 913, 192, 224/193, 198, 243, 244, 242, 245, 246

[56] References Cited

U.S. PATENT DOCUMENTS

| | | | |
|---|---|---|---|
| 1,113,530 | 10/1914 | Audley | 224/911 X |
| 1,421,578 | 7/1922 | Schussler | 224/243 |
| 1,635,984 | 7/1927 | Corriston | 224/919 X |
| 1,641,439 | 9/1927 | Jovino | 224/911 X |
| 1,851,352 | 3/1932 | Denkert | 224/911 X |
| 1,876,613 | 9/1932 | Clark | 224/193 |
| 1,930,203 | 10/1933 | Jewett | 224/193 |
| 1,951,865 | 3/1934 | Franz | 224/244 |
| 2,001,321 | 5/1935 | Berns | 224/193 |
| 2,109,734 | 3/1938 | Preneta | 224/244 |
| 2,349,376 | 5/1944 | Ray | 224/244 |
| 2,551,913 | 5/1951 | Toby | 224/224 |
| 2,893,615 | 7/1959 | Couper | 224/193 |
| 3,008,617 | 11/1961 | Villwock | 224/183 |
| 3,531,031 | 9/1970 | Angell | 224/238 |
| 3,630,420 | 12/1971 | Bianchi | 224/193 |
| 3,645,428 | 2/1972 | Angell | 224/911 X |
| 3,669,325 | 6/1972 | Furman | 224/243 |
| 3,718,240 | 2/1973 | Rose | 224/243 |
| 3,777,952 | 12/1973 | Theodore | 224/243 |
| 3,828,990 | 8/1974 | Baldocchi | 224/193 |
| 3,866,811 | 2/1975 | Hamby | 224/911 X |
| 3,942,692 | 3/1976 | Chica | 224/243 |
| 3,977,583 | 8/1976 | Bianchi et al. | 224/193 |
| 4,055,015 | 10/1977 | Musgrave | 224/911 X |
| 4,256,243 | 3/1981 | Bianchi et al. | 224/244 |
| 4,277,007 | 7/1981 | Bianchi et al. | 224/193 |
| 4,298,150 | 11/1981 | Seldeen | 224/243 |
| 4,318,503 | 3/1982 | Capano | 224/911 X |
| 4,694,980 | 9/1987 | Rogers | 224/243 |
| 4,846,384 | 7/1989 | Perry | 224/244 |
| 4,925,075 | 5/1990 | Rogers | 224/244 |
| 4,934,574 | 6/1990 | Salandre | 224/244 |
| 5,018,654 | 5/1991 | Rogers et al. | 224/244 |
| 5,048,735 | 9/1991 | McCormick | 224/244 |
| 5,094,376 | 3/1992 | Baruch | 224/243 |
| 5,100,036 | 3/1992 | Rogers et al. | 224/244 |
| 5,129,562 | 7/1992 | Bianchi | 224/244 |

OTHER PUBLICATIONS

Autodraw II Holster, *Bianchi International Catalog*, p. 5, no date.

*The Don Hume Catalog*, no date.

The Safariland 008 Final Option, *Shooting Times Handgun Quarterly* article, Richard E. D. Nichols, pp. 28–31, no date.

"Security Holsters for Autos", *Shooting Times Handgun Quarterly* article, Richard E. D. Nichols, (Bianchi auto–draw models 3000 and 6100, pp. 64–69), no date.

*Primary Examiner*—Renee S. Luebke

*Assistant Examiner*—Glenn T. Barrett

*Attorney, Agent, or Firm*—Brown, Martin, Haller & McClain

[57] ABSTRACT

A handgun holster has a handgun receiving cavity in which a moveable trigger guard gripping device is mounted. The gripping device has at least one projection for extending into the trigger guard of a handgun, and is moveable with the gun between a first position in which the projection is rigidly held in the trigger guard and a second position in which the projection is only loosely biassed into the trigger guard so that it can be released by simply pulling the handgun away from the gripping device. The holster has a separate or integral pocket with a rigid locking surface which holds the projection in the trigger guard when the gripping device is in its first position, so that the gripping device must be moved to its second position before the gun can be released.

26 Claims, 5 Drawing Sheets

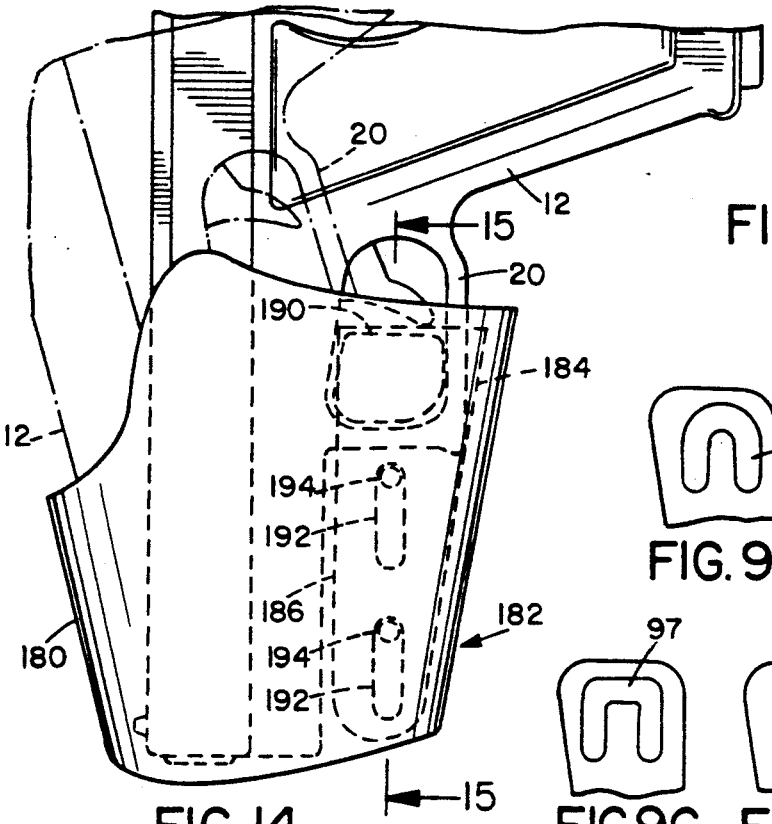
FIG. 14
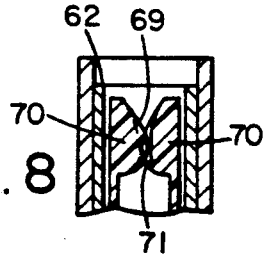
FIG. 8
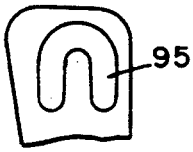
FIG. 9A
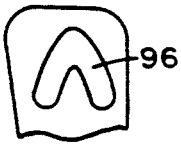
FIG. 9B
FIG. 9C
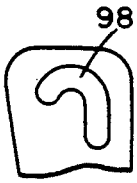
FIG. 9D
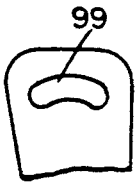
FIG. 9E
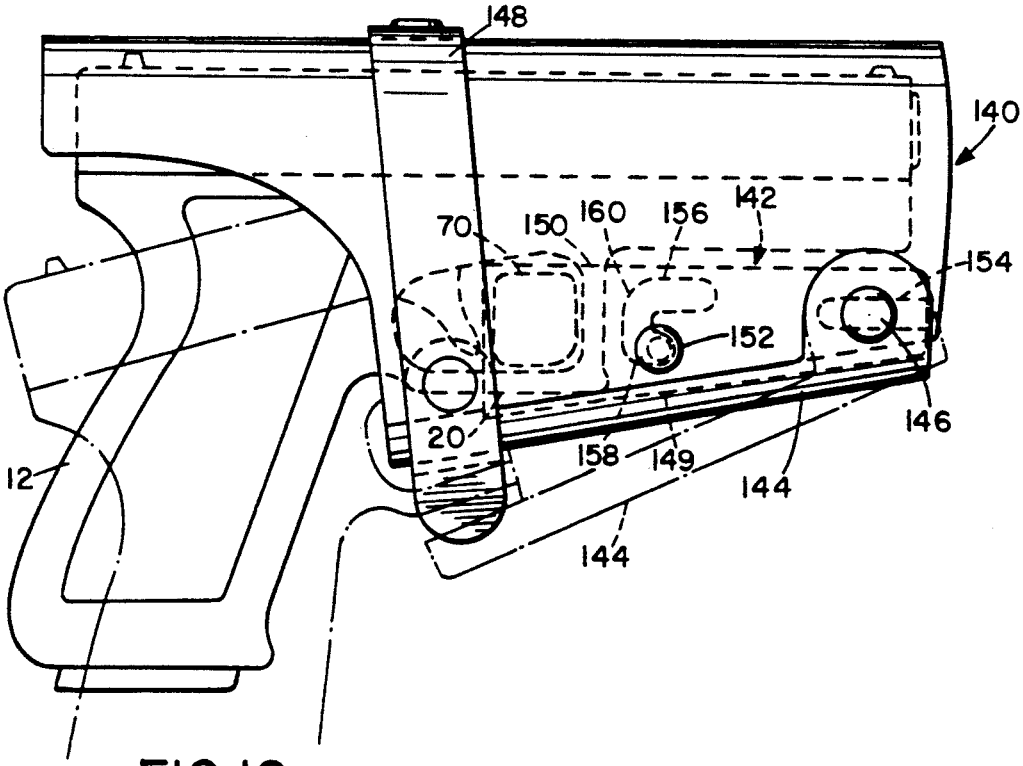
FIG. 10

HOLSTER WITH TRIGGER GUARD GRIPPING DEVICE

BACKGROUND OF THE INVENTION

The present invention relates generally to holsters for handguns, and is particularly concerned with holsters having security devices for reducing the risk of the gun being inadvertently removed from the holster or taken from the holster by an assailant.

There is a need for effective security holsters for use by police officers and others to aid in keeping a handgun securely holstered until and unless the wearer actively withdraws the gun. In the case of law enforcement personnel, such security holsters are needed since a holstered gun may otherwise be taken by an assailant from the holster and used against the officer. Such security mechanisms are desirable in all types of holsters, including belt carried holsters, shoulder holsters, and holsters used in handgun competitions, to reduce the risk of the handgun inadvertently being released from the holster, for example.

One problem with designing an effective security mechanism is that it must reduce the risk of an assailant pulling out the gun easily, but at the same time the officer must be able to draw the gun readily when needed. In the past, security holsters have been designed to grip revolver cylinders, the rear of the trigger guard bow of revolvers, or the front of the trigger guard bow on both pistols and revolvers, and the ejection port of pistols, as well as combinations of these gripping points. Thus, various types of gripping devices are mounted in the holster to grip various parts of the gun, providing passive resistance to the draw. However, these devices have the disadvantage that an assailant can still draw the gun if sufficient force is applied to release it from the gripping device. Additionally, abrasion to the gripping device and/or handgun surfaces may result from repeated forcing of the gun into and out of the device.

It is more difficult to design a gripping device for a pistol than for a revolver, since pistols do not have the projecting trigger guard bow nor the protruding cylinder of a revolver. Thus, most attempts to secure a pistol in a holster have focused on using the inside forward bow of the trigger guard or the ejection port as a gripping surface. For example, a number of prior security devices for holsters included latches which projected into the trigger guard bow and were disengaged by the user releasing the latch using their trigger finger. Such arrangements are described, for example, in U.S. Pat. Nos. 468,556 of Anderson, 1,113,530 of Audley, 1,851,352 of Denkert, 1,951,865 of Franz, 2,109,734 of Preneta, 2,349,376 of Ray, and 4,934,574 of Salandre. One risk in these types of devices is that release of the latch may lead to accidental discharge, and thus such devices are generally rejected by law enforcement agencies.

Another disadvantage of such latching mechanisms is that their release is often readily apparent to an observer. In one prior design, the holster actually flies open to release the handgun if a button inside the trigger guard is depressed. Thus, if accidentally released by an assailant during a scuffle, the assailant will immediately be aware that the gun can easily be taken. Such holsters are therefore often quite insecure.

The challenge is therefore to provide a security mechanism which allows easy insertion of the pistol into the holster and at the same time helps in preventing the pistol from being forcibly withdrawn from the holster while permitting the pistol to be drawn by the carrier relatively easily. At the same time, the mechanism must not be abraded by the pistol and also must not itself abrade the pistol surfaces.

In a large number of security holster designs, the holster has a fully or partially open front, and the gun is withdrawn by thrusting it forwardly through the front, rather than vertically upwards. However, this presents an inherently "insecure" appearance to a potential assailant and possibly invites such individuals to attempt to withdraw the gun. One example of this type of holster is described in U.S. Pat. No. 4,277,007 of Bianchi et al., in which a holster with a spring closed front incorporates a metal spring member having a plastic protrusion mounted at its free end. The protrusion fits into the trigger guard of the pistol, and is designed to prevent upwards draw while allowing the pistol to be pulled forward out of the latch and through the spring-closed holster front. Other front open or opening holsters to allow forward draw are described in U.S. Pat. Nos. 4,846,384 of Perry, 4,925,075 of Rogers, and 5,018,654 of Rogers. In U.S. Pat. No. 4,925,075 of Rogers a spring-biassed catch or boss in the side wall of the holster engages the trigger guard to resist removal of the gun from the holster. In U.S. Pat. No. 5,018,654 of Rogers a restraining device is mounted in the walls of the holster to resist removal of the handgun by pulling up directly. The device has opposing pyramidal bosses which have gently-sloping sides facing the top and back of the holster but sharp perpendicular sides facing the front and bottom of the holster. The gently-curved back face allows the projections to be pushed apart to release the trigger guard if the handgun is first pushed forward, while the sharp sides prevent a direct vertical upward movement.

There are a number of disadvantages to these types of forward draw security mechanisms. One, as mentioned above, is that such holsters are often fully or partially open at the front, presenting an insecure, "please take me" appearance, to the potential detriment of the officer. Another disadvantage is that, because the trigger guard area of a pistol is small, releasing the pistol from a device which statically grips the guard can usually be effected by a very short forward pull, so that a determined assailant may be able to extract the pistol quite easily. The forward draw holster used by law enforcement personnel is well known to many felons, and they are often quite aware of the steps necessary to take pistols from such holsters. Finally, the wear on the security mechanism is often high because of the need to provide a device which will leave the pistol unabraded by repeated drawing and holstering.

Other security holsters are known which provide draw to the rear, but these are subject to similar disadvantages and additionally ignore the potential threat to an officer by attack from the rear.

Some security holsters also incorporate strap systems for retaining the holster in place, either alone or in addition to a trigger guard gripping mechanism. The straps must normally be released by the user before drawing the gun.

The challenge of gripping the pistol has led to some mechanisms which have been excessively bulky, weak, difficult to use, short-lived, or even ineffective. Additionally, more complex systems generally require extensive training for the carrier to be able to use them effectively.

SUMMARY OF THE INVENTION

It is an object of the present invention to provide a new and improved security holster for a handgun.

According to one aspect of the present invention, a holster for a handgun is provided, which comprises a holster body having a handgun receiving cavity, a gripping device receiving pocket in the cavity, and a trigger guard gripping device movably mounted in the pocket for movement between a first position within the pocket and a second position projecting at least partially out of the pocket. The gripping device includes at least one gripping projection positioned to enter the finger guard of a handgun inserted in the holster. The pocket includes a bearing surface for rigidly holding the projection in the finger guard when the gripping device is in the first position, the projection being released from the bearing surface when the gripping device is moved into the second position so that the handgun is held only loosely. A releasable locking mechanism is provided for releasably locking the gripping device in the first position when the handgun is inserted in the holster.

Preferably, the gripping projection is provided on a flexible finger which will engage loosely over the trigger guard when the device is in the second position, allowing the gun to be removed by forcibly pulling it away from the gripping device, but which is rigidly held in the trigger guard by the pocket bearing surface when in the first position. The pocket may be formed integrally in the inner walls of the holster itself, or may comprise a separate channel member mounted in the rear wall of the holster.

Also in the preferred embodiment, the gripping mechanism is in the form of a pair of opposed, flexible gripping fingers which can be released relatively easily once they are moved out of the pocket. This greatly reduces wear on the mechanism, since the fingers are very flexible in the holstering mode, and completely rigid only when in the locked mode.

Any suitable looking mechanism may be provided, but in the preferred embodiment of the invention a camming mechanism is used for releasably locking the gripping device in the pocket. In one version, the gripping device has a camming slot while a pin extends from the inner wall of the pocket through the camming slot. The camming slot is arranged to prevent direct movement of the gripping device from the first to the second position. Instead, the gripping device must first be moved in an unlocking direction so that the pin travels along the slot before it can be released. The cam release may be provided by urging the gripping device in any direction, but in the preferred embodiment of the invention the camming slot is an inverted U- or V-shape so that the gripping device must be pushed downwardly before it can be released. The legs of the slot may be of the same or different lengths. Additionally, the camming slot may be provided in the pocket instead of the gripping device, with the gripping device having a pin projecting into the slot. In alternative embodiments, the gripping device may be released by upwards or horizontal movement out of the pocket, depending on the application.

The gripping device is released from the pocket by urging the holstered gun, and thus the gripping device, in the appropriate direction, either downwardly, upwardly, or horizontally, depending on the shape of the camming slot, and then urging the gun and gripping device in an appropriate direction away from the pocket until the gripping projection of the device is released from the pocket, allowing the gun to be pulled out of the gripping device.

In the preferred embodiment of the invention, the pistol and gripping device are released by an initial downward movement, followed by a movement in another different direction, such as upwards or horizontally out of the front or rear of the holster. Thus, the gun cannot be released by a straight pull in any one direction. In practice, an assailant will typically pull on the pistol's grip in an upwards direction in attempting to free the gun, and will either not know the correct combination of movements required to release the gun or be unable to effect them in a struggle. In contrast, the wearer can be given training to enable them to release the gun quickly and easily when needed.

Instead of simply pulling a gun in a single movement out of a gripping device with sufficient force to overcome the gripping force of the device, the gripping device itself must be moved from a first, locked position into a second position before the grip on the pistol can be released. This adds more security and reduces the need for a very strong gripping device which could potentially damage the handgun surfaces by abrasion.

According to another aspect of the present invention, a handgun holster is provided which has a pivoting front or rear closure. In the case of a forward draw holster, the pivoting front closure is designed to provide a completely closed front wall to the holster, providing a more secure appearance and also reducing the risk of dirt and debris entering the holster. The pivoting closure may be held in its closed position by a releasable strap arrangement, for example, adding another level of security to the holster when used in combination with the trigger guard gripping device.

For additional security, the holster may be provided with releasable straps extending upwardly over the top of the holstered pistol. The straps may be released via a thumb-snap arrangement, for example. Use of the two sets of straps in addition to the trigger guard gripping device provides three levels of security to an officer. The vertical straps must first be released, followed by the strap extending around the pivoting front closure. When these are released, the gun can be pivoted through the front opening of the holster, simultaneously pivoting the front closure forwards. However, the pistol is still secured against falling out of the holster by means of the gripping device, and must be positively pulled out of this device in order to draw the gun. A similar arrangement may be provided for a rear draw via a pivoting rear closure.

In some non-law enforcement applications, less security is necessary and multiple layers of gun retention may not be desired. For example, competition holsters emphasize speed first and security second. Use of the trigger guard gripping device of this invention alone, without any additional securing straps, would provide a sufficient level of security, possible with some additional quick release mechanism such as a spring for biassing the gripping device and pistol into the second position, towards the user, when the lock is released.

This gripping mechanism may be used in any type of holster to reduce the risk of the pistol inadvertently being dislodged, from law enforcement applications to competition holsters. Additional levels of security may be provided for law enforcement applications to additionally reduce the risk of an assailant gaining access to the gun.

BRIEF DESCRIPTION OF THE DRAWINGS

The present invention will be better understood from the following detailed description of some preferred embodiments of the invention, taken in conjunction with the accompanying drawings, in which like reference numerals refer to like parts, and in which:

FIG. 8 is a view similar to a portion of FIG. 6, showing interlocking gripping fingers;

FIGS. 9A to 9E illustrate alternative cam slot configurations for the gripping means;

FIG. 10 is a side elevation view of a further holster configuration suitable for use as a shoulder holster;

FIG. 14 is a side elevation view of a holster having a modified trigger guard retainer;

DESCRIPTION OF THE PREFERRED EMBODIMENTS

Figure 1:
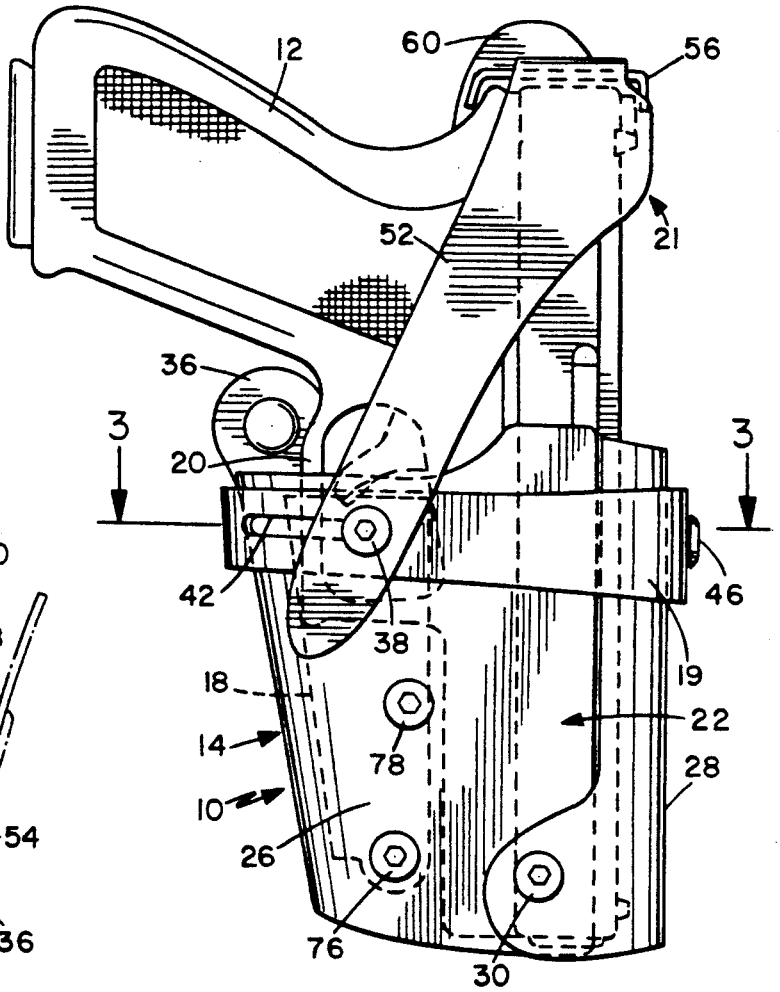
FIG. 1 is a side elevation view of a security holster according to a first embodiment of the invention, with a pistol secured in place.

FIGS. 1 to 6 of the drawings illustrate a security holster 10 according to a first embodiment of the present invention. This holster has three levels of security, and is particularly intended for use by persons such as law enforcement officers who are likely to encounter assailants or criminals who might attempt to take a handgun or pistol 12 from the holster. This holster is particularly designed to be worn at the belt or waistband via a suitable paddle or belt loop suspending device, for example, although it may be worn as a shoulder holster in other embodiments.

The holster illustrated in the drawings is designed for a handgun of the pistol type, although equivalent security mechanisms may be used in a similar fashion for revolver holsters.

The holster basically comprises an outer body or shell 14 defining an internal cavity 16 for receiving a gun, and a trigger guard retainer mechanism 18 within the cavity for gripping the trigger guard 20 of a handgun inserted in the cavity to provide one level of security. In addition to retainer mechanism 18, two additional levels of security are provided via wrap-around strap 19 and upper strap system 21, as will be explained in more detail below. The holster body 114 is in two parts, with a first, generally U-shaped, open fronted part 22 defining the rear wall 24 and side walls 26 of the cavity 16, and the second part 28 comprising a pivoting front closure for the open front of the part 22. The front closure 28 is pivoted via pivot pins 30 at its lower end to lower portions of the side walls 26 adjacent the front opening, as best illustrated in FIGS. 1 and 2.

Figure 2:
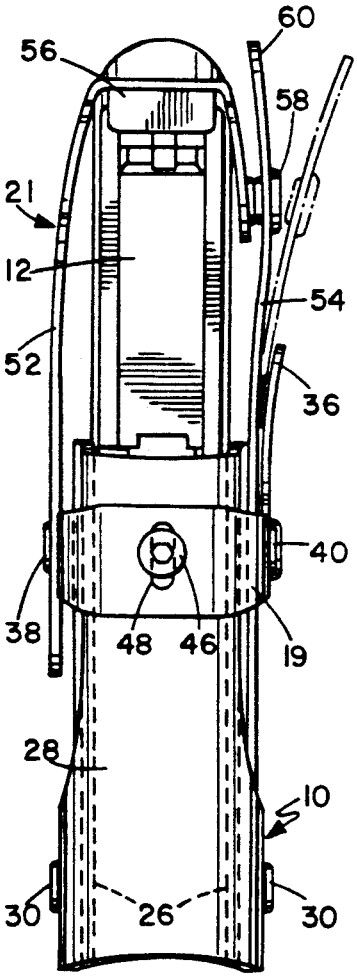
FIG. 2 is a front elevation view of the holster and pistol.
Figure 3:
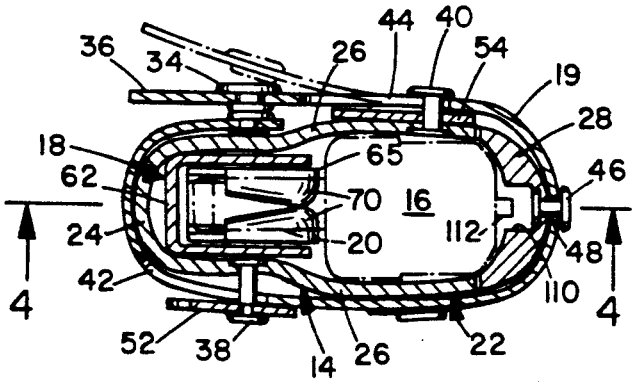
FIG. 3 is a sectional view taken on line 3—3 of FIG. 1.
Figure 5:
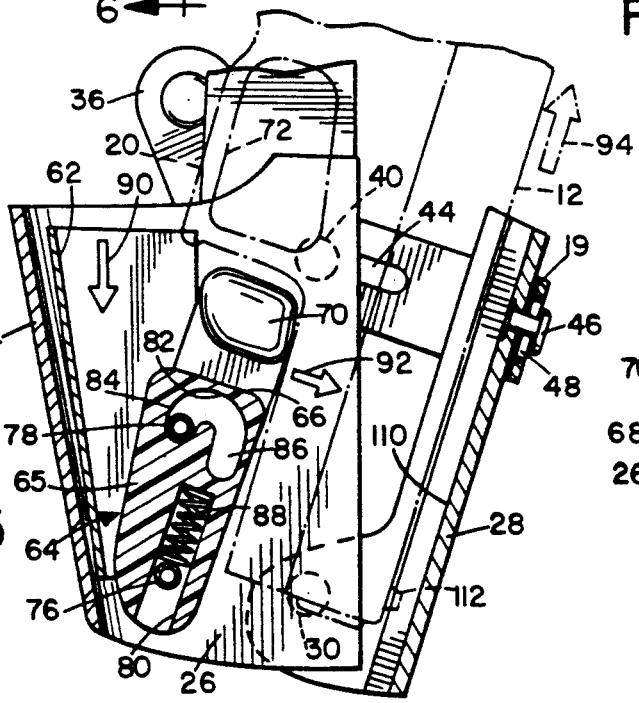
FIG. 5 is a view similar to FIG. 4, with the holster unlocked and the pistol released.

The pivoting front closure 28 is normally secured in the closed position illustrated in FIGS. 1 and 3 via transverse strap 19 which wraps around the holster body adjacent the upper open end of the holster, providing security against opening of the holster front. Opposite ends of the strap 19 are releasably secured together via a snap fastener 34, with one end having a projecting finger tab 36 for releasing the snap. The strap is secured to the opposite side walls of the holster body via fasteners 38, 40 which may be screws, rivets or the like and which extend through elongated, axially extending limit slots 42, 44, respectively, in the strap, as best illustrated in FIGS. 1 and 3. A central portion of the strap is secured to the front closure 28 via another fastener 46, which extends through a short vertical slot 48 in strap 32. When snap fastener 34 is released, the front closure can pivot forwards about pins or rivets 30 until the fasteners 38, 40 reach the ends of the respective slots, as best illustrated in FIG. 5. The vertical slot 48 accommodates the pivoting movement.

Figure 4:
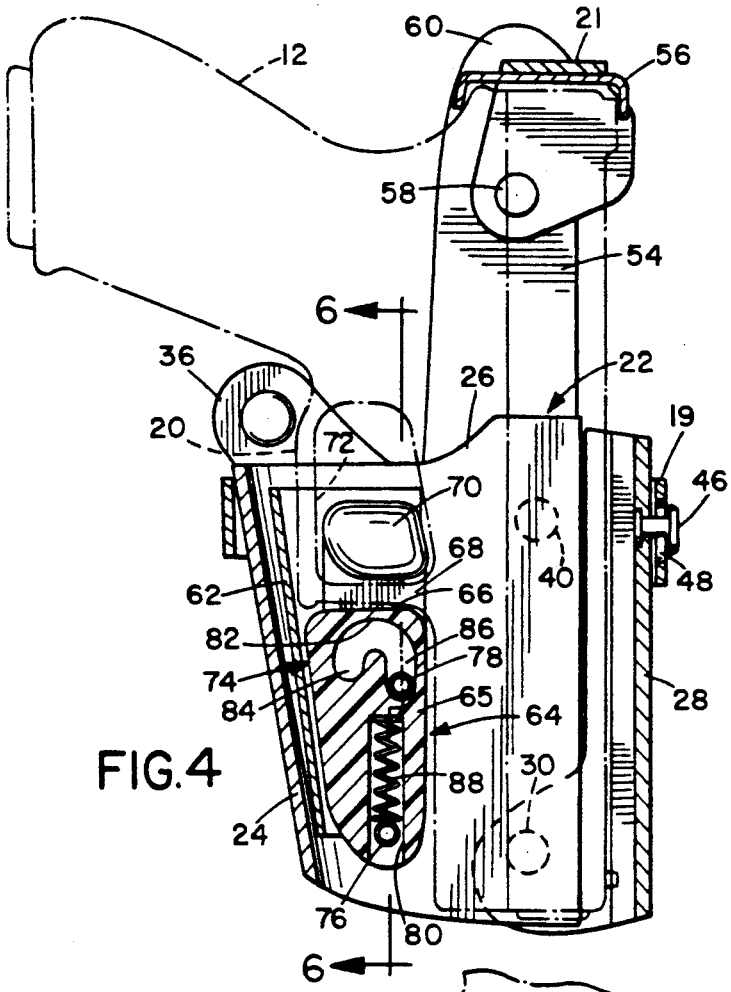
FIG. 4 is a sectional view taken on line 4—4 of FIG. 3.

Another level of security is provided via the top strap system 21 which is designed to extend from the open upper end of the holster over the top of the gun when inserted in the holster. The top strap system comprises a pair of straps 52, 54 which are each secured at one end to the respective opposite side walls of the holster body via the same fasteners 38, 40 which secure opposing parts of transverse strap 32 to the side walls. Strap 52 has a loose, pivoting connection to the holster side wall, while strap 54 is rigidly secured in place between strap 32 and the holster side wall. Strap 52 is bent over at its upper end with a shaped cup member 56 secured inside its bent over portion to form a square or rectangular-shaped recess for engaging over the back end of the pistol as best illustrated in FIGS. 1, 2 and 4. The free end of strap 52 is secured to the free end of strap 54 via a suitable snap fastener 58, with strap 54 having a projecting thumb tab 60 for release of the fastener. Cup or recess 58 will prevent the strap from slipping forward or rearward to release the pistol. This strap system 50 presents the first level of security for a gun in the holster and must be released before any of the other security devices can be accessed.

The main security mechanism which holds the pistol in the holster when the two sets of straps 19 and 21 have been released is the trigger guard retainer mechanism 18, which is best illustrated in FIGS. 3 to 6. The mechanism 18 basically comprises a rigid pocket or channel member 62 mounted in the rear wall of cavity 16, and a trigger guard gripping device 64 releasably mounted in pocket 62 for movement between the locked position illustrated in FIG. 4 and the released position illustrated in FIG. 5. The trigger guard gripping device 64 comprises an elongate block 65 having a pair of opposed flexible fingers 68 projecting from its upper end 66 to extend on opposite sides of a pistol trigger guard when positioned in the holster, each finger having a protrusion 70 projecting inwardly from its upper end for extending into the trigger guard opening 72 to snag or retain the trigger guard. When the device 64 is in the locked position of FIG. 4, the pocket traps the flexible fingers 68 in the trigger guard opening with the front of the trigger guard resting on the end 66 of the block from which the fingers project. This prevents release of the handgun until the pistol/finger block combination is moved out of the pocket. Although in the illustrated embodiment the pocket 62 is a separate, generally U-shaped channel member of relatively rigid plastic material or metal, it may alternatively be formed integrally with the holster rear wall, which may be shaped to trap the flexible fingers 68 in an equivalent manner.

Figure 7:
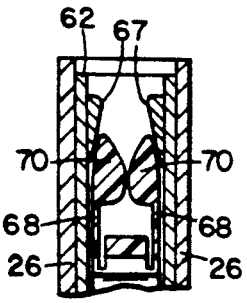
FIG. 7 is a view similar to a portion of FIG. 6, showing additional clamping means for the gripping elements.

Although in the illustrated embodiment the trigger guard is trapped by a pair of opposed flexible fingers extending into the trigger guard opening, only one such finger with a protrusion at its free end may be used in alternative arrangements. The fingers may be integral with the block or may be separate and secured to the block via suitable fasteners. Additionally, the inner faces of the pocket may be tapered or shaped to form raised areas 67 for biassing the free ends of the fingers inwardly, as illustrated in FIG. 7, when the finger block is trapped in the pocket, thus urging the finger protrusions even further into the trigger guard opening. FIG. 8 illustrates another optional modification in which the opposing finger protrusions have a tongue and slot interlocking mechanism 69, 71 when biased towards one another via the rigid surfaces of the pocket, providing even more security.

Figure 6:
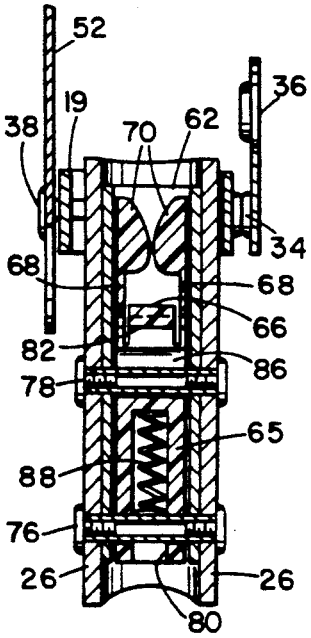
FIG. 6 is a sectional view taken on line 6—6 of FIG. 4.

The finger block or gripping device 64 is held in the locked position illustrated in FIG. 5 by a suitable releasable locking device. The locking device is provided in the illustrated embodiment by a camming mechanism 74 between the pocket or channel and the finger block, although alternative releasable locking devices may be provided in other embodiments. As best illustrated in FIGS. 1, 4 and 5, a pair of fasteners 76, 78 such as screws, rivets or the like extend through the holster, pocket and finger block. The finger block is provided with a pair of slots 80, 82 through which the respective fasteners extend, the lowermost slot 80 comprising a straight vertical slot, and the uppermost slot comprising a camming slot. In the illustrated embodiment, the camming slot is of inverted U-shape, with one leg 84 of the U-shape being shorter than the other leg 86, although other alternative cam slot shapes may be used in alternative embodiments, as described below. Additionally, it will be understood that the camming slot may be provided in the side walls of the pocket rather than in the finger block, in alternative arrangements. Preferably, a biassing spring 88 extends between fastener 76 and the upper end of slot 80, as illustrated in FIGS. 4 and 6, urging the block upwardly.

As mentioned above, FIG. 4 illustrates the finger block in a trapped, locked position in pocket 62 with the protrusions 70 projecting into the finger guard opening to trap the finger guard and prevent removal of the pistol by pulling upwards on the handle, even if the straps are all released. A forwards or rearward pull on the gun will also not release the gun, since the finger block is trapped in the pocket via fastener 78 which is held in one leg or locking portion 86 of the U-shaped camming slot. In this position, the finger block cannot move out of the pocket either upwardly or sideways.

The only way the gun can be released is to first push down on the gun in the direction of the arrow 90 in FIG. 5, against the biassing spring 88, so that the finger block is pushed downwardly relative to the pocket and fasteners 76, 78, with the spring being compressed against the fastener 76 as fastener 76 travels upwardly in slot 80, and the fastener 78 travelling along the leg of the camming slot to its rounded end portion. As soon as fastener 78 reaches the rounded end portion of the camming slot, the finger block can be urged outwardly at its upper end out of pocket 62 in the direction of arrow 92 in FIG. 5, releasing the flexible fingers from the rigid pocket while the fastener 78 travels along the round end of the camming slot into the other leg. At this point the spring urges the finger block back upwardly so that the fastener travels to the end of the shorter leg of the slot, locking the finger block in the open or released position.

Once the finger block has moved to the released position of FIG. 5, the fingers are free to allow the pistol to be released by a relatively effortless tug, for example in the direction of arrow 94 in FIG. 5, although the release direction may be in other directions such as horizontally in other applications. In order to re-holster the gun, it is pushed back down into the holster with the finger block positioned as in FIG. 5 so that the fingers can flex back outwardly over the trigger guard and then move inwardly into the trigger guard opening, at the same time pushing the block downwardly sufficiently to move the fastener out of leg 84 so that the block can be pivoted inwardly back into the pocket. Spring 88 then urges the block back upwardly so that fastener 78 travels to the end of locking leg 86 to trap the block in place and hold the fingers in the trigger guard opening, positively retaining the pistol in the holster.

Although the camming slot 82 is an inverted U-shape in the embodiment illustrated in FIGS. 1 to 6, alternative cam slot shapes may be used in alternative embodiments to achieve the desired effect of locking the finger block in the pocket until it is moved in a first, cam release direction which is different from the direction required to actually move the finger block out of the pocket. With a U-shaped slot as in FIGS. 1 to 6, the finger block is released by first pushing downwards and then urging the upper end of the block outward towards the front of the holster. However, in alternative arrangements the sequence of movements may be different, such as downwards then upwards, for example, or downwards then to the rear of the holster. Some possible alternative cam slot shapes are illustrated in FIGS. 9A to 9E. FIG. 9A illustrates an inverted U-shape camming slot 95 in which both legs are the same length, providing the same amount of locking in both the trapped and released positions of the finger block. FIG. 9B illustrates an inverted V-shape camming slot 96 which will have substantially the same effect but a more definite lock to unlock position. FIG. 9C illustrates a squared, inverted U arrangement 97. The arrangements in FIGS. 9A to 9C will be ambidextrous since they are symmetrical, allowing the same mechanism to be used for both right and left handed holsters. FIG. 9D illustrates an alternative, asymmetrical camming slot 98 in which the release leg is much shorter than in FIGS. 4 and 5, providing only a very slight locking action in the open or released position of FIG. 5. FIG. 9E illustrates an alternative, slightly arcuate slot 99 with no detent, allowing the pistol and finger block to be simply pivoted out of the pocket, without having to first push down on the pistol. Other alternatives include a sideways square bracket or an L-shape where the finger block must be urged sideways a short distance before it can be pulled upwardly to release the fingers, for example.

Although in the illustrated embodiments the fasteners and camming slots are oriented to extend between opposite sides of the holster, the fasteners may alternatively extend through the rear wall of the holster and pocket and into the block, with the camming slots being orientated accordingly.

Use of the trigger guard retainer device alone provides a significant amount of security to hold a pistol fairly reliably and solidly in the holster unless the necessary combination of actions is taken to release the finger block from the pocket and subsequently the pistol from the fingers. Thus, holsters may be designed which utilize this level of security only, particularly for applications where less security is necessary, such as competition holsters and holsters which are carried concealed. However, the version illustrated in FIGS. 1 to 6 has two additional levels of security for a very high security holster, suitable for carrying by police officers and other law enforcement personnel, for example. One of these levels comprises the hinged front closure 28 which is pivoted at the muzzle of the holster, as described above, in conjunction with the closure strap 19 or other device which normally holds the front in the closed position of FIG. 1. This avoids the "please take me" appearance of fully or partially open fronted, front draw holsters which might otherwise invite an assailant to attempt to remove the weapon. The hinged front closure may be used alone, without the trigger guard retainer, in some applications in which less security is required, and in this case it may be adjusted to squeeze or apply pressure to the pistol surfaces in the manner of a clamp or vise to inhibit withdrawal without first releasing the front.

The hinged front closure may be made of the same material as the rest of the holster body, such as relatively rigid plastic or leather, and may be extruded, injection molded, or otherwise heat formed. Preferably, a sight groove 110 extends along the inner face of the closure for receiving the front sight 112 of a pistol, as illustrated in FIG. 3. Alternatively, the groove may be omitted or may form the entire cross section of the pivoted front closure.

The use of a strap encircling the hinged front and the remainder of the holster body can provide a form of limiter, which will permit the front to fall open only so far as is necessary to release the pistol, as determined by the length of the slots 42 and 44. When used together with the retainer 18 as in FIGS. 1 to 6, the length of slots 42 and 44 coincides with the movement necessary to fully unlock the finger block. In the case of a simpler holster in which the retainer 18 is omitted, the front may be arranged to tilt forward just far enough to release the pistol. Preferably, the hinged front stays open after drawing the gun, so that it is ready for re-holstering, although it may be spring biassed towards the closed position. When used with the trigger guard retainer, the front is unbiased and will stay open so that the trigger guard can be re-engaged on the gripping fingers.

The top strap system 50 presents the first line of defense for the wearer, and this can be released by an officer using their thumb to release the snap fastener, as illustrated in dotted outline in FIG. 2. At this point the strap 52 falls down to release the rear or handle end of the pistol. With the top straps released, the pistol is still securely held in the holster by both the transverse strap 19 encircling the holster body and the fingers of finger block 66 trapping the trigger guard 20. In order to release the gun from this point, the officer must first release strap 32. This is done by pushing finger tab 36 outwardly. The finger tab 36 is positioned where the third finger of the user may release it conveniently before drawing the gun. After releasing strap 32, the user pushes down on the pistol sufficiently to release fastener 78 from the camming slot leg 86, and then pushes the pistol forwards, carrying the finger block into its released position and simultaneously moving the hinged front of the holster into its forward position until the limits of the slots are reached. The front of the holster will then remain open until the gun is re-holstered.

At this point, with the hinged front pivoted open and the finger block released, the pistol is still secured inside the finger block against accidentally falling out of the holster. This provides additional security and is useful when the pistol has been drawn and now needs to be holstered for an urgent task such as handcuffing a suspect or engaging in foot pursuit. In such cases there may be insufficient time for an officer to completely lock the pistol in place. If there is sufficient time to do so, the officer may also choose to completely lock the pistol in place in the trigger guard retainer. Additionally, the pivoting front closure may be closed and fastened via strap 32, and, if there is sufficient time, the top strap system may be re-secured. Thus, the officer may choose from several layers of security, depending on the time and the situation.

The motions necessary to release the trigger guard retainer are relatively complex and would not be natural to an assailant unfamiliar with the holster. Assailants typically pull upwards on a gun when struggling with an officer, which would be completely ineffective with this particular holster. Pushing the gun downwards would be contrary to the assailant's natural instincts, and thus they would be unlikely to be able to remove the gun, However, even though the downwards release is unnatural for an untrained assailant, it is relatively simple to learn, and thus the officer or carrier of the holster can be trained to release the locking mechanism quickly and easily.

In this embodiment, the pistol moves several times farther forward in the unlocking of the mechanism as was necessary in prior art forward draw holsters for pistols. The greater unlocking range gives the wearer more security and more time to utilize his or her weapons retention training during a struggle.

Wear on the mechanism and the pistol is also greatly reduced because the gripping surfaces or fingers can be designed to be very flexible when released from the pocket, and completely rigid only in the locked or trapped mode in the inflexible, relatively rigid retaining pocket. Moving the finger block out of the pocket frees the fingers to release the pistol without undue stress or wear on the fingers or the pistol.

FIG. 10 illustrates another alternative holster 140 incorporating a similar retainer 142 to the previous embodiments. However, in this embodiment, the holster is configured for a rear draw rather than a front draw and is particularly intended for use in a cross-draw holster suspended either underneath the arm in a shoulder holster arrangement or from the waist in a belt suspended holster arrangement. This type of holster would typically be used, for example, for carrying a concealed weapon.

In a concealed holster, the amount of security needed is typically less than for an exposed holster where unauthorized removal by others is a substantial risk to the wearer. Thus, the holster 140 does not use the upper securing straps, but only uses trigger guard retainer 142 to provide security against the pistol accidentally falling from the holster. Additionally, holster 140 is designed to provide a relatively fast draw. In this embodiment, the holster is provided with a pivoting rear wall or closure 144 rather than a pivoting front wall, to provide the necessary freedom of movement to release the pistol from retainer 142. Closure 144 is pivoted to the lower end of the holster via pivot pin or rivet 146 adjacent the muzzle of pistol 12, and is normally retained in the closed position via a releasable, wrap-around securing strap 148 or other quick release mechanism, in a similar manner to the front closure of the first embodiment.

As in the previous embodiments, retainer 142 comprises a rigid pocket 149 in the side walls of the holster adjacent the rear opening, which may be separate from or integral with holster 140, and a finger block 150 which is moveable between a trapped position inside pocket 149 and a released position in which at least the trigger guard retaining fingers, which may be identical to the fingers 68 in the first embodiment, are released from the pocket. The released position is illustrated in dotted outline in FIG. 11. The pocket is positioned adjacent the rear opening of holster 140, and the finger block 150 is retained in the pocket via a locking cam mechanism as in the previous embodiments. As in the first embodiment, fasteners 146, 152 extend through the pocket and finger block, with either the pocket or finger block having a straight slot 154 and a camming slot 156 through which the respective fasteners extend. With the fastener 152 in the position illustrated in FIG. 11 at the end of the shorter leg 158 of the U-shaped camming slot, the finger block will be trapped in pocket 148. In order to release the finger block, and thus the pistol, the strap 148 is first released, and the pistol is pushed down a short distance sufficient for fastener 152 to enter the straight top portion 160 of slot 156. The pistol can then be pulled out through the rear of the holster, pushing out the rear closure 144 simultaneously into the dotted line position in FIG. 11, and pulling the finger block out of the rigid pocket to release the fingers. At this point a small pull on the pistol will be sufficient to flex the fingers to release the trigger guard from the fingers.

The holster and retainer mechanism may be configured for any type of draw, including cross-draw, underarm vertical, horizontal or upside down draw. In such cases, the pocket will be formed by the rigid sidewalls of the holster opening at the wearer's front (which may be at the front or rear of the holster).

Figure 11:
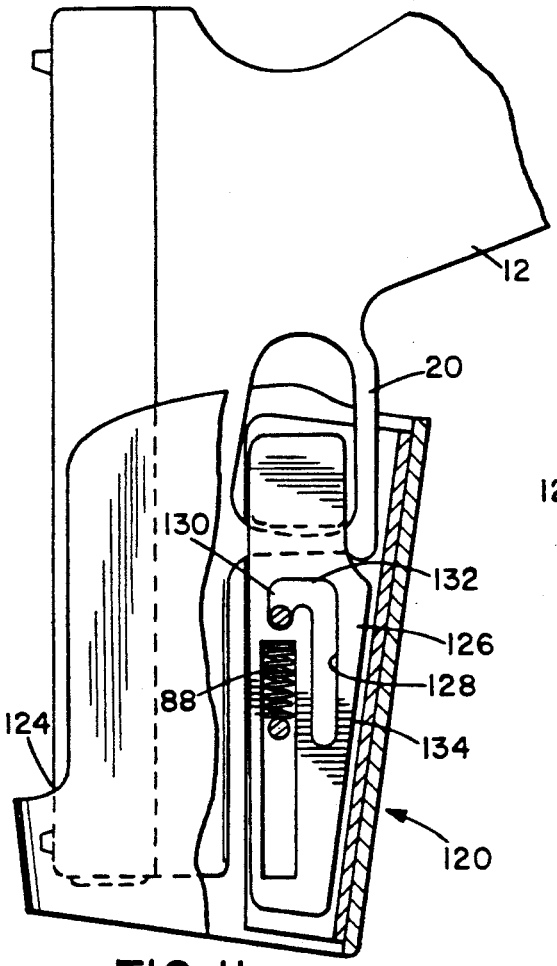
FIG. 11 is a side elevation view of an alternative non-hinged holster with a trigger guard retainer.
Figure 12:
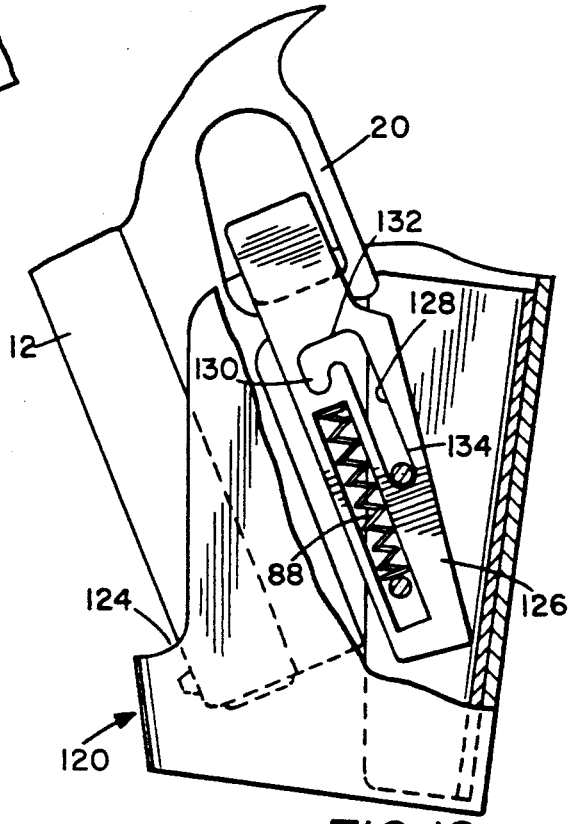
FIG. 12 is a view similar to FIG. 11 illustrating the gun unlocked from the holster.

FIGS. 11 and 12 illustrate a security holster 120 according to an alternative embodiment of the invention in which the two sets of fastener straps are eliminated for a faster draw. This embodiment would be useful as a competition holster or in other applications where attack by potential assailants is not a major concern.

In this embodiment, the hinged front is also eliminated and the holster body forms a cavity with fixed surrounding walls. The body has a recessed region 124 in its front wall to form a very large opening at the front for movement of the pistol into the released position, as illustrated in FIG. 12, while the trigger guard retainer 126 holds the gun securely in place until positively released, where otherwise such a low profile holster might lead to accidental dislodging of the gun.

The trigger guard retainer 126 in FIG. 11 is basically equivalent to that of the previous embodiment, and like reference numerals have been used where appropriate. However, in a competition application, the camming slot 128 is preferably of modified shape so that only a small movement is necessary to release the fastener 129 from the short leg 130 of the slot, allowing the finger block to move out of the pocket as fastener travels along the straight portion 132 of the camming slot. Spring 88 may be a strong spring which acts to actually thrust the pistol towards the wearer and out of the holster, along longer leg 134 of the camming slot, as illustrated in FIG. 12, providing a partial ejection feature for a faster draw. Holstering for a quick movement by the competitor from one position to the next would be possible by simply reinserting the pistol into the finger block, whether or not the wearer chooses to completely lock the pistol into the retainer under severe time constraints.

In the open front, competition holster 120 of FIG. 11, the pocket may be a separate channel member secured to the inside of the holster as in FIGS. 1 to 6, or may be formed integrally with the body of the holster. Additionally, a pocket may be provided which may be integral with the moving finger block to receive the muzzle of the pistol, with the pocket moving with the finger block as the pistol is released.

Figure 13:
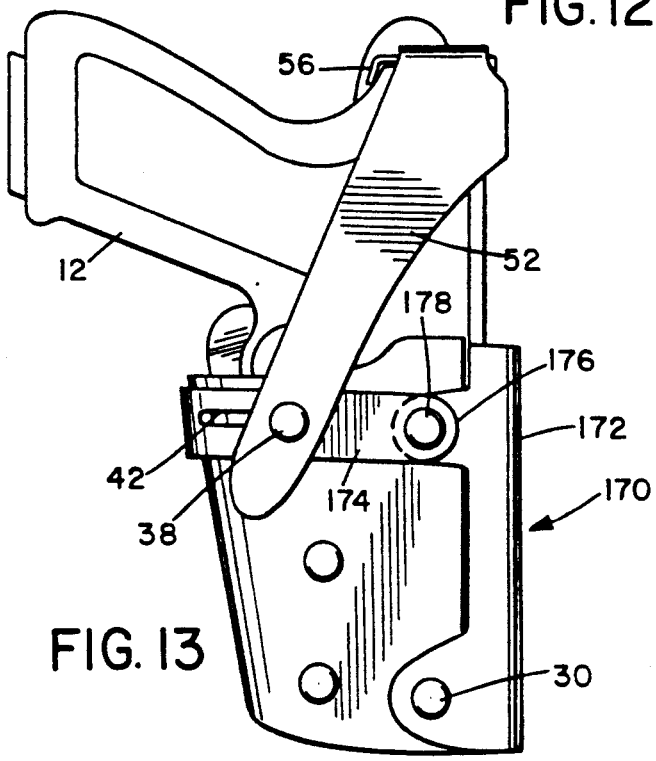
FIG. 13 is a side elevation view of a holster with a modified retaining strap arrangement.

FIGS. 13 illustrates a security holster 170 having a pivotal front closure wall 172 Which is held closed as in FIG. 13 by a modified release strap 174 which extends only partially around the holster rather than wrapping completely around the closure and remainder of the holster, as in the version of FIGS. 1 to 6. Opposite ends 176 of the strap are secured to opposite sides of the pivotal closure wall 172 via fasteners 178. The strap arrangement is otherwise identical to that of the previous embodiment, and like reference numerals have been used where appropriate. The strap 174 will be in two parts which have a snap fastener arrangement which is released via finger tab 36, as are the ends of strap 19 in the first embodiment.

The pivotal front wall and release strap may be used in conjunction with a trigger guard retainer as in the first embodiment, or alone in the case where less security is needed. When finger tab 36 is released, front wall 172 can pivot forwards about pin 30 by the amount allowed by slot 42, allowing the gun to be drawn.

Figure 15:
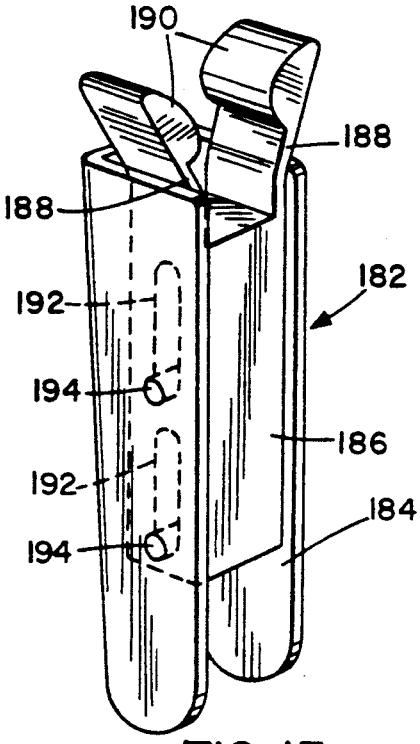
FIG. 15 is a perspective view of the trigger guard retainer of FIG. 14 showing the locking fingers released.
Figure 16:
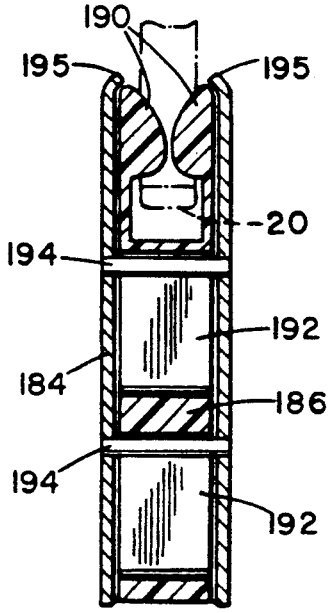
FIG. 16 is a section on the lines 16—16 of FIG. 14 but with the locking fingers held in the channel.

FIGS. 14 to 16 illustrate a holster 180 with a trigger guard retainer 182 according to another embodiment of the invention, in which the gun may be drawn by pulling straight up out of the holster.

The retainer 182 is best illustrated in FIGS. 15 and 16, and comprises a rigid pocket or channel member 184, which may be formed separately or integrally with the holster walls, and a gripping device or finger block 186 which grips a gun trigger guard 20 when fully inserted in the holster with the block inside the channel, as in FIG. 16. The finger block 186 has a pair of projecting fingers 188 at one end with opposing protrusions 190 for projecting into the finger guard when held in the closed position illustrated in FIG. 16 by the opposing walls of the channel. The fingers are biassed outwardly so that they snap open to release the trigger guard when they move out of the channel, as in FIG. 15.

Finger block 186 has a pair of straight cam slots 192 extending parallel to the holster axis. Pins 194 project through the respective slots from the side walls of channel 184. This ensures that the finger block can only move out of the channel in one direction, as indicated by the arrow in FIG. 15, with the pins 194 travelling from the top to the bottom of slots 192. No spring is required in this version. The draw in this case will be straight up and out of the holster, while the holstered pistol will be held solidly against falling out through the front or top of the holster. Optionally, as illustrated in FIG. 16, channel 184 may have an in-turned lip 195 at its upper end to resist the initial upward pull of the pistol.

Figure 17:
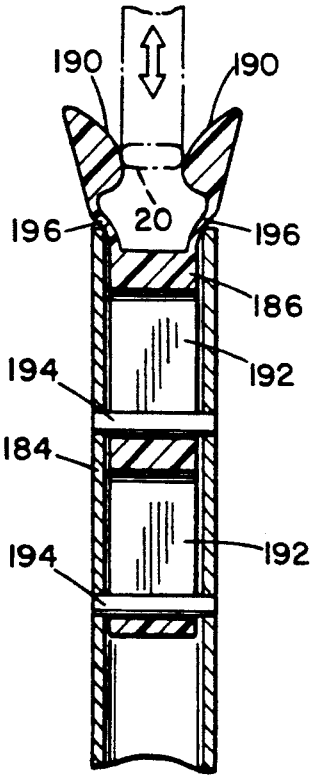
FIG. 17 is a view similar to FIG. 16 illustrating a modification with the fingers in the released position.

When the pistol is to be drawn, a pull on the pistol in the direction of the arrow in FIG. 15 will pull the fingers free of the pocket, and they will then snap open to release the trigger guard. Re-holstering the pistol will simultaneously push the finger block down into the channel into the closed position of FIG. 16. Optionally, the fingers 188 may have outwardly-facing ridges 196 for resting on the end of the channel when the finger block is in the released position, as illustrated in FIG. 17. This keeps the fingers out of the pocket or channel and open ready for re-holstering. The holstering action will force the fingers back into the pocket.

Figure 18:
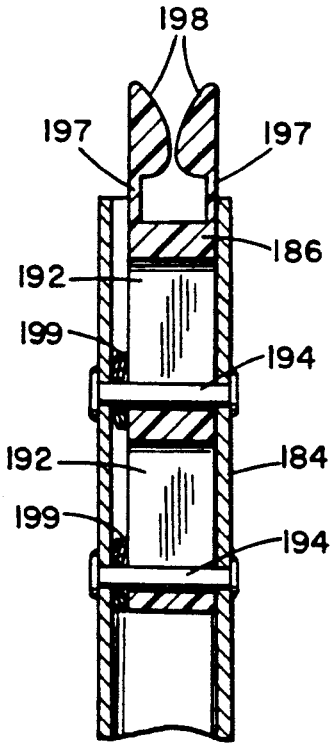
FIG. 18 is a view similar to FIG. 17 illustrating another modification.

FIG. 18 illustrates another modification in which the finger block 186 has fingers 197 which are not biassed open or closed, but remain in the orientation of FIG. 18 unless forced slightly open by urging a trigger guard past protrusions 198. Belleville-type spring washers 199 or similar mechanisms between the finger block and pocket may be used to keep the fingers up and out of the pocket and ready for holstering. The cam slots will be the same as in FIG. 15, so that the pistol is drawn by first pulling up so that the finger block is pulled up into the position of FIG. 18. At this point, an additional pull on the pistol will force the finger guard to deflect the fingers apart so it can be removed.

The version of FIGS. 15 and 16, with or without the optional modifications of FIGS. 17 and 18, is particularly suitable for a competition holster where it allows a quick, straight-up draw but prevents the pistol from accidentally falling out of the holster.

In the various embodiments of this invention described above, a much higher level of security is provided than was previously available in a holster, since the trigger guard gripping device is normally trapped and must be positively moved in order to release its primary grip on the trigger guard, disengaging the flexible locking fingers from the rigid biassing surfaces of the pocket. This is both different and more secure than a fixed trigger guard retainer where all that is required is the application of sufficient force to release the trigger guard, or a trigger guard latch which is released in a single step operation. This retainer can be used in any type of holster, including police uniform holsters, concealable belt and shoulder holsters, cross-draw holsters, competition holsters, military holsters, sporting holsters, and others.

The pivoting front or rear closure also provides a level of security and a more secure appearance to a front or rear draw holster which would otherwise have a partial or complete opening. This may be used alone or in combination with the trigger guard retainer for added security.

Although some preferred embodiments of the invention have been described above by way of example only, it will be understood by those skilled in the field that modifications may be .made to the disclosed embodiment without departing from the scope of the invention, which is defined by the appended claims.

I claim:

1. A handgun holster, comprising:

a holster body having a handgun receiving cavity with a first open end for receiving a handgun and a second end;

a substantially rigid locking pocket within the handgun receiving cavity;

a trigger guard gripping device movably mounted in the cavity for movement between first and second positions, the gripping device having at least one gripping projection for projecting into a trigger guard of a handgun inserted in said cavity, the gripping projection being located in said locking pocket in the first position of said device and projecting out of said pocket in the second position of said device; and said pocket having at least one bearing surface for locking said gripping projection in said trigger guard in the first position of said gripping device;

said gripping projection being moved from said pocket on movement into said second position to permit withdrawal of a handgun from said gripping device.

2. The holster as claimed in claim 1, wherein said gripping device includes resilient biassing means for biassing said gripping projection into said trigger guard, said bearing surface comprising means for rigidly holding said projection in said biassed position when said gripping device is in said first position, said gripping projection comprising means for gripping said trigger guard for movement with a handgun in a handgun drawing direction to said second position, and for releasing said trigger guard if said handgun is pulled away from said gripping device in said second position.

3. The holster as claimed in claim 1, wherein said gripping device includes resilient biassing means for biassing said gripping projection out of said pocket in said second position.

4. The holster as claimed in claim 1, including a releasable locking mechanism for releasably locking said gripping device in said first position.

5. The holster as claimed in claim 4, wherein said locking pocket and gripping device have interengageable cam parts comprising said locking mechanism, one of said cam parts comprising a camming slot of predetermined shape and the other cam part comprising a pin projecting transversely through said slot to allow movement of said gripping device relative to said pocket only in a predetermined travel path along the length of said slot, the pin being located at a first end of said slot in the first position of said gripping device and being located at the opposite end of said slot in the second position of said gripping device.

6. The holster as claimed in claim 5, including biassing means for biassing said pin towards the first end of said slot.

7. The holster as claimed in claim 5, wherein said gripping device is moveable in a first direction between said first and second positions, and said camming slot has a first portion extending in a different direction to said first direction for resisting movement in said first direction and allowing movement of said gripping device in a second, unlocking direction to an intermediate position, and a second portion extending in said first direction for allowing movement of said gripping device in said first direction from said intermediate position to said released position.

8. The holster as claimed in claim 7, wherein said second, unlocking direction is towards the second end of said handgun receiving cavity.

9. The holster as claimed in claim 5, wherein said camming slot is a straight slot and said travel path is towards the first end of said cavity.

10. The holster as claimed in claim 1, wherein said locking pocket comprises a pair of opposed side walls defining a channel in said cavity, and said trigger guard gripping device comprises an elongate member pivotally mounted at one end in said channel for pivotal movement at its opposite end between said first position in said pocket and said second position outside said pocket, said gripping projection being located at said opposite end.

11. The holster as claimed in claim 1, wherein said gripping device has a pair of opposed gripping projections for projecting in opposite directions into the trigger guard, said gripping projections being held rigidly in said trigger guard by said bearing surface in said first position.

12. The holster as claimed in claim 11, wherein said gripping device includes resilient biassing means for biassing said gripping projections out of said trigger guard in said second position.

13. The holster as claimed in claim 1, wherein said holster body has a front opening, a handgun in said cavity being drawn from said holster by movement through said front opening, and said gripping device being moved from said first to said second position by said drawing movement of said handgun.

14. The holster .as claimed in claim 13, further including a releasable front closure member for closing the front opening of said holster body, and releasable retaining means for normally retaining said front closure member in a closed position closing said front opening to prevent drawing of said handgun.

15. The holster as claimed in claim 14, wherein said front closure member comprises a pivotally mounted front wall of the holster, the front wall being pivotal from the closed position to an open position by movement of a handgun through said opening when said retaining means is released.

16. The holster as claimed in claim 14, wherein said retaining means comprises at least one strap extending between said holster body and front closure member and fastener means for releasably fastening the strap to hold said closure member closed.

17. The holster as claimed in claim 16, including limit means for limiting movement of said closure member from said closed position to a predetermined open position when said strap is released.

18. The holster as claimed in claim 17, wherein said strap has at least one slot extending lengthwise along part of the length of said strap and said holster body has a pin extending transversely through said slot, said pin and slot comprising said limit means for restricting movement of said closure member to a distance corresponding to the length of said slot.

19. The holster as claimed in claim 1, including an additional retainer mechanism for restricting movement of said pistol out of said cavity, said additional retainer mechanism comprising a pair of straps extending upwardly from opposite sides of the upper open end of the holster, and fastener means for releasably securing the straps together over the back of a handgun in the holster, one of the straps having a bent over end portion for extending across the back of the handgun, and a cup-shaped recess in said bent over end portion for gripping the back of the handgun to resist slipping of said straps off said handgun.

20. The holster as claimed in claim 1, wherein said holster body has a rear opening, said handgun being drawn from said holster by movement through said rear opening and said gripping device being moved into said second position by movement of said handgun through said rear opening.

21. A handgun holster, comprising:

a holster body having a handgun receiving cavity with an open first end for receiving a handgun in a holstered position in said cavity;

the handgun receiving cavity having a substantially rigid locking pocket;

a trigger guard gripping device movably mounted in said cavity for movement between a first position engaging said locking pocket and a second position moved away from said locking pocket, the gripping device having at least one gripping projection for extending into a trigger guard of the handgun to resist removal of the handgun from the cavity; and the locking pocket comprising means for engaging said gripping projection in said first position of said gripping device to prevent movement of said gripping projection out of said trigger guard, said gripping projection being moved away from said locking pocket on movement of said gripping device into said second position to permit withdrawal of a handgun from said gripping device, whereby said gripping device must be moved from said first to said second position before a handgun can be drawn out of said gripping device.

22. The holster as claimed in claim 21, including additional locking means for releasably locking said gripping device in said first position.

23. The holster as claimed in claim 22, wherein said additional locking means comprises means for blocking movement of said gripping device directly from said first position towards said second position and allowing movement of said gripping device in an unlocking direction towards an intermediate, released position where it is free to move to said second position.

24. The holster as claimed in claim 23, wherein said unlocking direction is away from the first end of said cavity.

25. The holster as claimed in claim 21, wherein said locking device comprises a pocket in said cavity having at least one rigid bearing surface for engaging said gripping projection to hold said projection in said trigger guard.

26. A trigger guard retainer for releasably holding a handgun in a holster, comprising:

a pocket member having opposing side walls; and a trigger guard gripping device movably mounted in said pocket member for movement in a predetermined path between a first position and a second position, said gripping device projecting at least partially out of said pocket at least in said second position;

the gripping device having gripping means for gripping a handgun trigger guard at least in said first position; and said pocket member side walls having at least one bearing surface for locking said gripping means into said trigger guard in the first position of said gripping device;

said gripping means being released from said pocket on movement into said second position to permit withdrawal of a handgun from said gripping device.

* * * * *